United States Patent [19]

Nafte

[11] Patent Number: 4,752,980

[45] Date of Patent: Jun. 28, 1988

[54] APPARATUS FOR IMPARTING MOTION TO CRADLES OR THE LIKE

[75] Inventor: David I. Nafte, Philadelphia, Pa.

[73] Assignee: D&M Rocker, Philadelphia, Pa.

[21] Appl. No.: 945,076

[22] Filed: Dec. 22, 1986

[51] Int. Cl.[4] ..... A47D 9/04

[52] U.S. Cl. ..... 5/109; 5/108

[58] Field of Search ..... 5/109, 108, 101, 105, 5/107; 128/33

[56] References Cited

U.S. PATENT DOCUMENTS

| | | | |
|---|---|---|---|
| 1,500,009 | 7/1924 | Smaldone | 5/109 |
| 1,795,246 | 3/1931 | Brown | 5/109 |
| 2,478,445 | 8/1949 | Yurkovich | 5/109 |
| 2,841,802 | 7/1958 | Leverett | 5/109 |
| 4,028,753 | 6/1977 | Rios | 5/108 |

*Primary Examiner*—Alexander Grosz

[57] ABSTRACT

Disclosed is an apparatus for imparting motion to cradles or the like. Apparatus of the present invention impart gentle and soothing rocking motions to cradles and the like without the need for manual rocking by the parent or guardian of the child. Various motions may be imparted to the cradle either separately or in combination. The apparatus includes a guide frame pivotally mounted to a support frame for pivotal movement about a central longitudinal axis of the guide frame. The guide frame defines a longitudinal guide path therealong. A platform is supported by the guide frame for movement along the guide path. Means mounted to the support frame are provided for moving the platform back and forth along the guide path. Means mounted to the support frame for pivoting said guide frame about a central longitudinal axis are also provided.

20 Claims, 3 Drawing Sheets

APPARATUS FOR IMPARTING MOTION TO CRADLES OR THE LIKE

The present invention relates to apparatus for safely supporting cradles and the like. More particularly, apparatus of the present invention provide safe support for a baby, particularly a sleeping baby, while imparting gentle motions which are soothing and comforting to the baby.

It is known that the sleep of children and babies, especially infants less than three months old, contains a large proportion of "active sleep", or what is known as rapid eye movement (REM) sleep. In addition, the sleep patterns of babies and infants are known to contain more frequent transitions between REM sleep and non-REM sleep. As a result, new parents often find it difficult to put their new babies to sleep, and are often discouraged by babies or infants who frequently awaken during the night. It has long been known that gentle motions, such as rocking, may be used as a means for inducing sleep in a child who is awake, and that such motions are also helpful for maintaining sleep in a child who is passing through a period for awakening. See for example, chapter 14 of the book "Nighttime Parenting" by William Sears, M.D. However, such knowledge has not been particularly advantageous to parents who must manually rock their baby to sleep at various hours of the day and night.

Accordingly, it is highly desirable and an object of the present invention to provide an apparatus for imparting gentle and soothing rocking motions to a cradle, crib or the like without the need for manual rocking by the parent or guardian of the child. It is also desirable and an object of the present invention to provide an apparatus in which motions may be either separately or in combination imparted to the crib or the like. It is also desirable and an object of this invention to provide an apparatus which includes means for allowing the extent and type of motion of the cradle or the like to be readily adjusted. Moreover, the present invention achieves these objects in an apparatus which is safe, economical, simply constructed, and easily repaired.

Several prior U.S. patents disclose apparatus which attempt to provide motion to a bed or the like. For example, U.S. Pat. No. 2,841,802 to Leverett discloses a bed or crib which is adapted to be rocked or shaken. The device of Leverett provides a frame which has curved sections and a bed which is supported by these curved sections for being rocked there along. The frame sits on rollers mounted on a base for longitudinal movement of the frame relative to the base. Movement is imparted by rocking the bed along the curved sections of the frame and by moving the frame longitudinally with respect to a base. Longitudinal movement of the frame with respect to the base is accomplished by a finger attached to the base which rides along a curved track in a rotating cam. Since the longitudinal track is of a fixed dimension, the longitudinal travel of the frame disclosed in Leverett is not readily adjustable. Moreover, since the rocking motion provided by Leverett is imparted directly to the bed while the back-and-forth longitudinal motion is imparted to a frame upon which the bed sits, the device of Leverett is relatively complex and cumbersome.

U.S. Pat. Nos. 1,795,246-Brown and 1,500,009-Smaldone are directed to mechanical gliders and the like for imparting a single back-and-forth longitudinal motion to the crib. These apparatus both suffer from the disadvantage of imparting only a single motion which may not be soothing and satisfying to the baby. The cradle rocker disclosed in U.S. Patent No. 2,478,445 to Yurkovich suffers from a similar disadvantage in that the apparatus provides for only a single swinging motion about a central lateral axis.

In order to achieve the above stated objects of the present invention and to avoid the disadvantages of the prior art, one embodiment of the present invention comprises a support frame and a guide frame having a longitudinal guide path, said guide frame being pivotally mounted to the support frame for pivotal movement about a central longitudinal axis of the guide path. A platform supported by the guide frame for movement along the guide path is also provided. Also included are means mounted to the support frame for moving the platform back and forth along the guide path, and means mounted to the support frame for pivoting said guide frame about a central longitudinal axis.

DETAILED DESCRIPTION OF PREFERRED EMBODIMENTS

Figure 1:
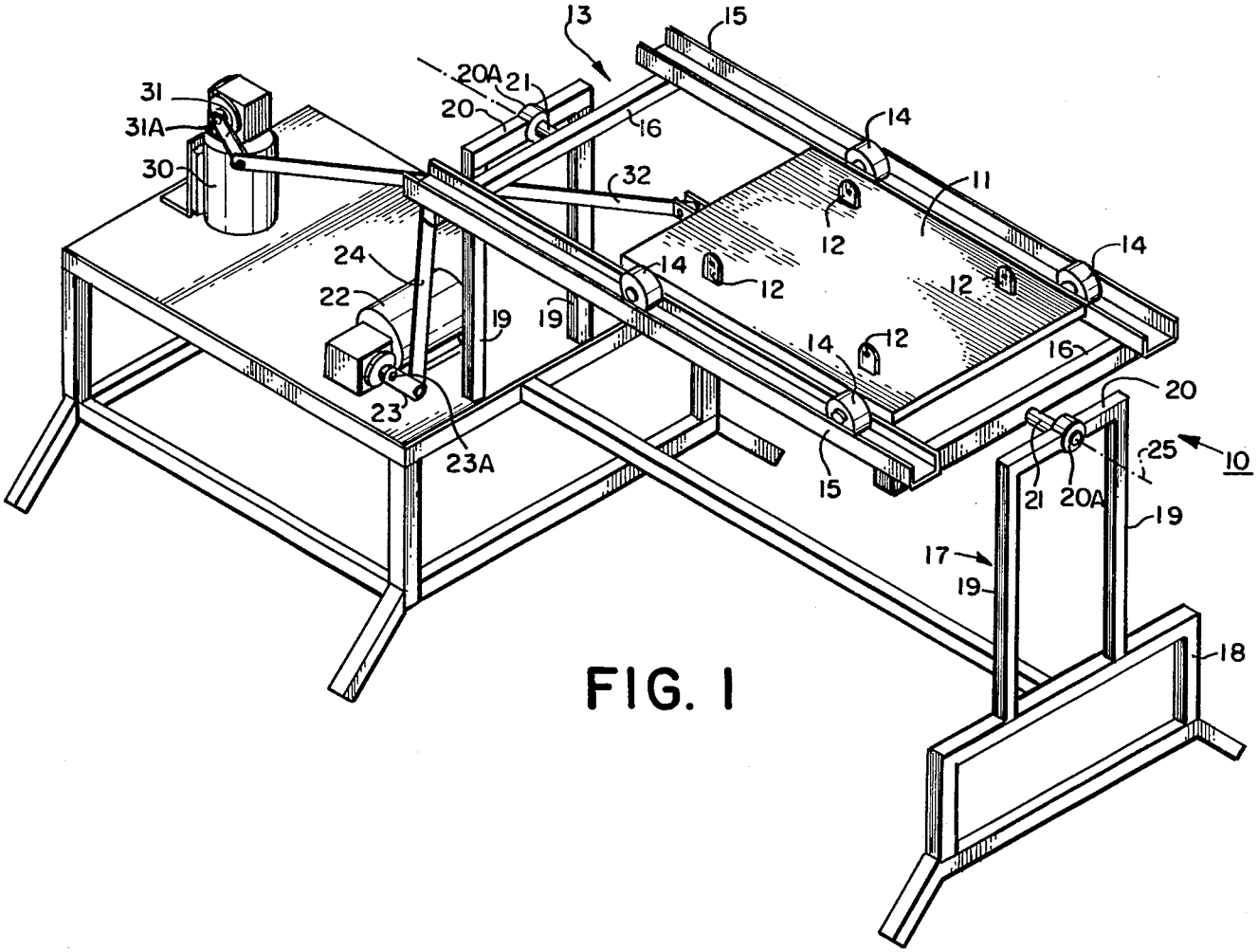
FIG. 1 is a perspective view of a cradle rocking apparatus according to a first embodiment of the present invention.
Figure 2:
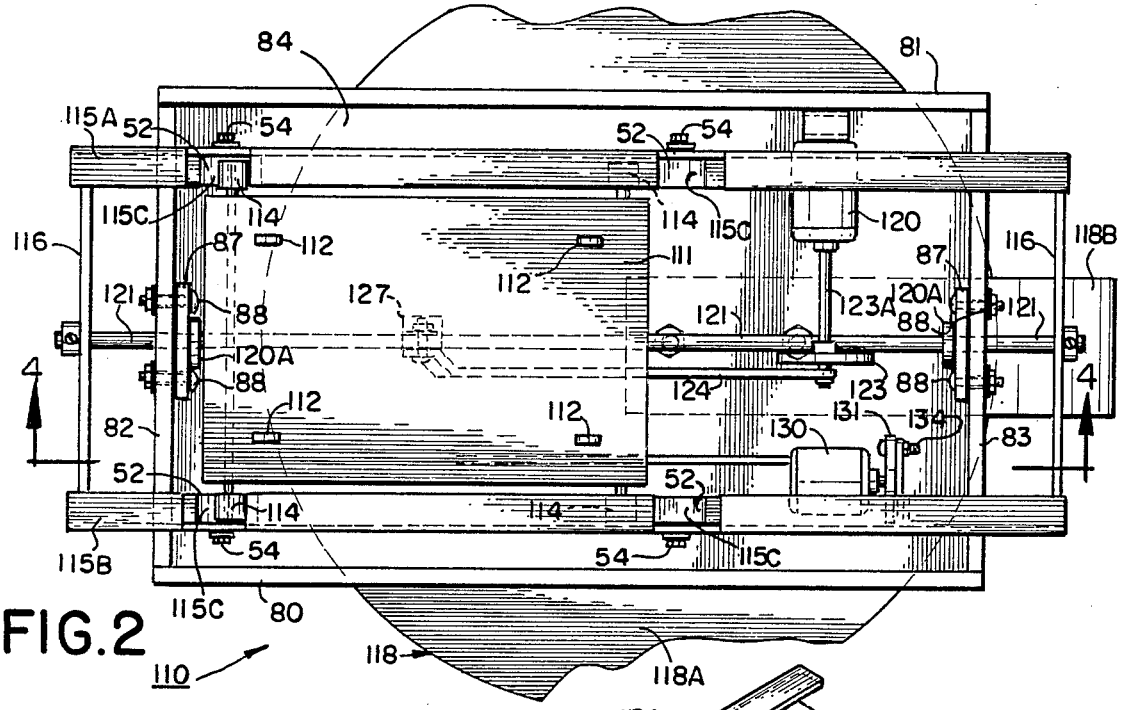
FIG. 2 is a perspective view of a cradle rocking apparatus according to a second embodiment of the present invention.

A first embodiment of the present invention will now be described in connection with the apparatus depicted in FIG. 1. The cradle rocker of this embodiment, generally designated as 10, comprises a platform 11 to which a cradle, crib, pram or the like is to be mounted. It will be appreciated by those skilled in the art that the length, width, and shape of platform 11 may be varied as required. For the purposes of convenience, the term cradle will hereinafter be used to refer to any structure used to comfortably support a baby or a child. While such a cradle may be mounted to platform 11 by any means well known in the art, mounting brackets 12 are provided for such a purpose. The platform 11 is movably supported by a guide frame, generally designated as 13. In particular, the platform 11 includes rollers or wheels 14 which allow movement of the platform 11 along the C-shape guide rails 15 of the guide frame 13. Guide frame 13 also comprises a pair of cross arms 16 which support and connect guide rails 15 in a substantially parallel manner. In this way, guide frame 13 provides a guide path along which platform 11 may be easily moved in a longitudinal direction. While the apparatus disclosed in FIG. 1 provides a substantially linear guide path in the longitudinal direction, it will be appreciated by those skilled in the art that other guide paths may be provided. For example, it may be desirable to provide guide frame 13 with a sinusoidal guide path which provides a sinusoidal motion as the platform moves longitudinally along the guide frame.

By providing a guide frame having a guide path as described above, it is possible to provide a rocking motion to platform 11 without impeding the ability of platform 11 to move back and forth along the provided guide path. With respect to the embodiment described in FIG. 1, this is achieved by pivotally mounting guide frame 13 to a support frame. The support frame disclosed in the embodiment shown in FIG. 1, for example, comprises a pair of upstanding frame structures, generally designated as 17, which are supported by a base, generally designated as 18. Each support frame 17 comprises a pair of upstanding support members 19 and a substantially horizontal cross bar 20. The guide frame 13 is pivotally mounted to cross bars 20 by a pair of connecting arms 21. One end of each connecting arm 21 is attached to cross arm 16 of guide frame 13 while the other end of the connecting arm is rotatably supported by bearings 20A or the like in cross bar 20. According to a preferred embodiment of the present invention, the central longitudinal axes of connecting arms 21 coincide with central longitudinal axis 25 of both guide frame 13 and the guide path defined thereby. In this way, the guide frame 13 and hence platform 11 may be readily pivoted about a central longitudinal axis without interfering with the movement of platform 11 along guide rails 15. It will be apparent to those skilled in the art that the above-described structure provides a simple and effective means for imparting at least two independent rocking motions to a cradle. This independence allows the motions to be imparted either separately or jointly.

A first variable speed electric motor 22 is mounted to base 18 and includes a crank 23 as shown. Crank 23 is driven by motor 22 for rotation about point 23A. One end of the connecting arm 24 is pivotally attached to the crank 23 while the other end of the connecting arm is pivotally attached to guide frame 13. The point of connection between connecting arm 24 and guide frame 13 is not coincidental with a central longitudinal axis 25 of the guide frame. In this way, movement of crank 23 about point 23A imparts a pivoting motion to guide frame 13 about longitudinal axis 25 of the guide frame. It will be apparent to those skilled in the art that the complete circular rotation of crank 23 about point 23A causes an oscillatory rocking motion about the longitudinal axis 25 of the guide frame 13.

A second variable speed electric motor 30 is mounted to base 18 and includes a crank 31 as shown. Crank 31 is driven by motor 30 for rotation about point 31A. One end of connecting arm 32 is pivotally attached to crank 31 while the other end of the connecting arm is pivotally attached to platform 11. In this way, movement of crank 31 about point 31A imparts longitudinal movement to platform 11 along guide rails 15. It will be appreciated by those skilled in the art that the full rotation of crank 31 about point 31A causes platform 11 to move back and forth along the guide path provided by guide rails 15.

It will be appreciate by those skilled in the art that the structure described above provides an apparatus which is capable of: 1) imparting back and forth longitudinal movement to a cradle and 2) imparting rocking oscillatory movement to the cradle, and that these motions may be imparted either independently or in combination. Moveover, the provision of a platform which is movable longitudinally along a guide frame which is in turn pivotal about one of its central longitudinal axes provides a simple but very effective apparatus for achieving such motions either independently or in combination. In addition, the extent and rate of either movement may be readily adjusted by adjusting the point of connection between the crank and connecting arm and the speed of the electric motor respectively.

Referring now to FIGS. 2 through 6, a second embodiment of the present invention will be described in detail. The cradle rocker of this embodiment, generally designated as 110 in FIG. 2 comprises a platform 111 to which a cradle, crib, pram or the like is to be mounted. While such a cradle may be mounted to platform 111 by any means well known in the art, mounting brackets 112 are provided for such purpose. The platform 111 is supported by a guide frame, generally designated as 113, for movement therealong. The guide frame 113 is in turn supported by a support frame. The support frame, generally designated as 117 in FIG. 2, comprises an upwardly opening housing including opposite longitudinal side walls 80 and 81. The side walls 80 and 81 are interconnected by opposite end walls 82 and 83, and a bottom wall 84 extending between and interconnecting the lower marginal portions of the walls 80, 81, 82 and 83. The end walls 82 and 83 include slots 85, preferably centrally located vertical slots, formed therethrough. A pair of fastener slots 86A and 86B are located on opposite sides of slot 85.

The guide frame 113 comprises a pair of journal blocks 87 which are slidably mounted to the interior walls of end walls 82 and 83 by fasteners 88. Fasteners 88 are mounted to journal blocks 87 and are loosely contained within slots 86A and 86B such that the journal blocks may readily travel in the vertical direction. A support shaft 121 is rotatably supported by bearings 120A contained in journal blocks 87. The support shaft 121 loosely passes through and is slidably and rotatably contained within slots 85. A pair of V-shaped support arms 116 are fixedly mounted at approximately their apex to the ends of support shaft 121 which extend outside the end walls 82 and 83. According to the embodiment shown in FIGS. 2 through 5, the V-shaped support arm 116 is fixedly mounted to the support bar 121 by a sleeve 50 attached to the V-shaped support arm at about its apex and a set screw 51 which passes radially therethrough. In this way, tightening the set screws 51 serves to fixedly mount the V-shape support arm 116 to shaft 121. Fixedly mounted to the ends of V-shape support arms 116 is a pair of parallel guide rails or channel members 115A and 115B. In this way, the guide frame 113 provides a guide path along guide rails or channel members 115A and 115B for the rollers or wheels 114 mounted to platform 111. It will also be appreciated by those skilled in the art that the guide frame 113 as described above provides a guide path for platform 111 which may be oscillated about a central longitudinal axis, i.e., the axis of support shaft 121. The guide path thus defined may also be modified to include ramp blocks 52 adjustably mounted in channel members 115A and 115B by fasteners 54, as best revealed in FIG. 3 and as more particularly described hereinafter. In this way, the guide path may be modified to impart an upward vertical motion to platform 111 at various points along the longitudinal extent of the guide path.

The support frame 117 is mounted to a base assembly generally designated as 118. This base assembly 118 includes a lower circular base member 118A and a spring support arm 118B connecting the lower base member 118A to the bottom wall 84 of support frame 117. Accordingly, the support frame 117 is spring mounted from the lower base member 118A for limited omnidirectional movement relative thereto. It will be appreciated that for certain purposes, such as portability for example, it may be desirable to eliminate base assembly 118. In this case, support frame 117 may serve as a base for the cradle rocker.

Figure 3:
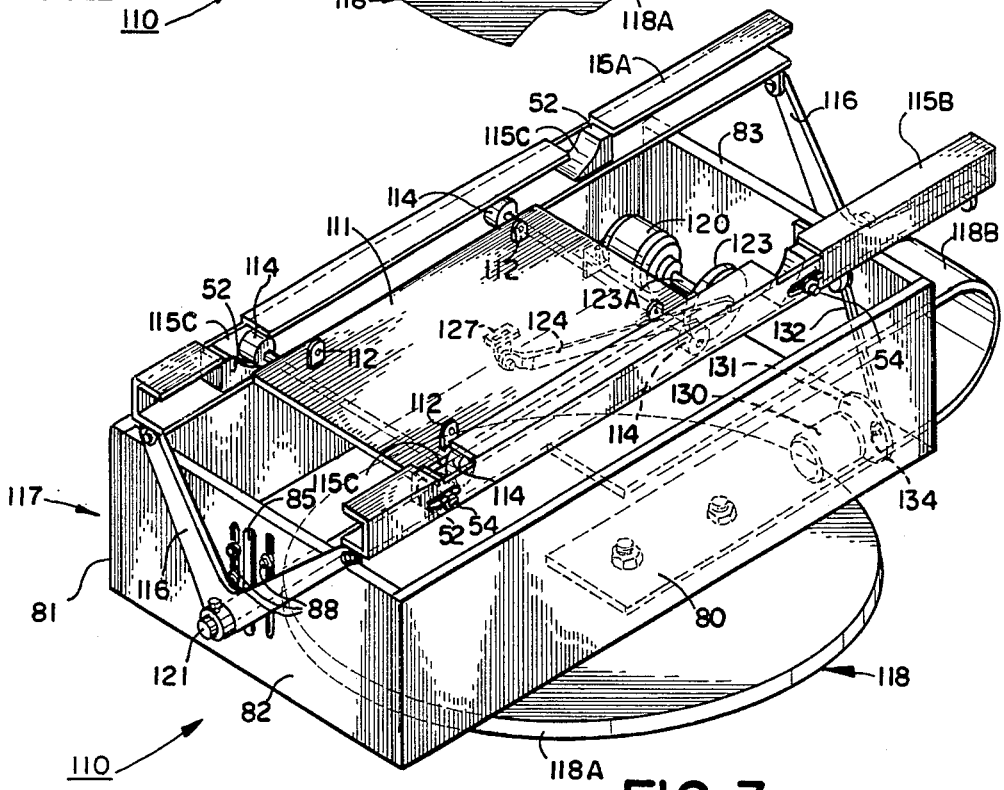
FIG. 3 is a plan view of the cradle rocking apparatus shown in FIG. 2.
Figure 4:
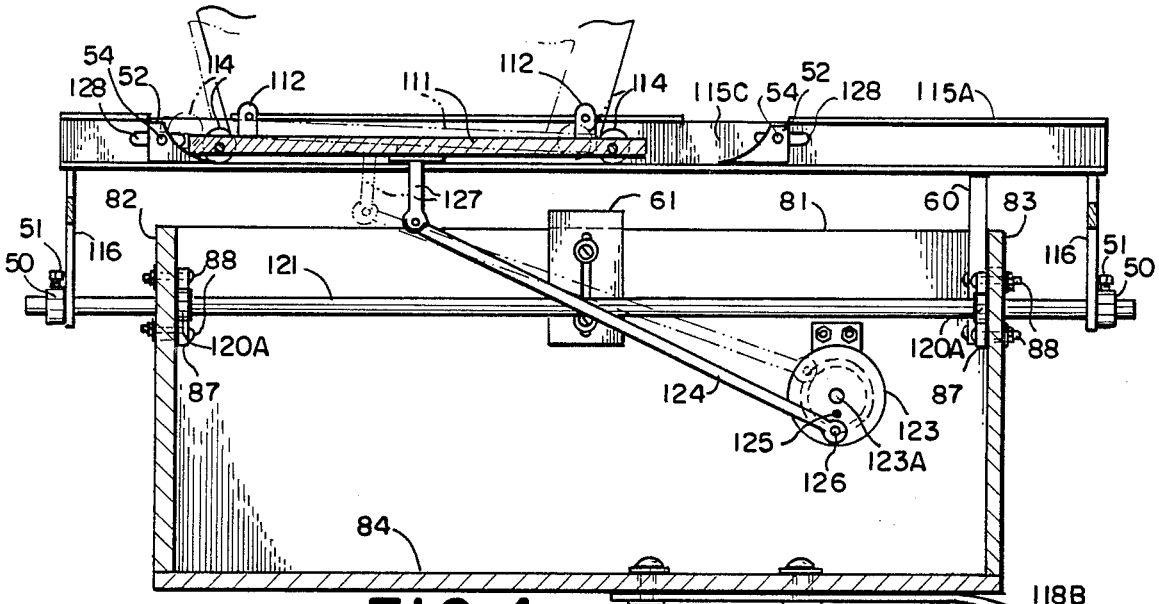
FIG. 4 is a cross-sectional view taken substantially along lines 4—4 of FIG. 3.

As best revealed in FIGS. 3 and 4, a first variable speed electric motor 120 is mounted from the side wall 81 and includes a rotary output shaft 123A upon which a crank disk 123 is mounted. The crank disk 123 includes radially spaced openings 125 through which a crank pin 126 may be secured. The crank pin 126 pivotally attaches one end of a connecting rod 124 to the disk 123. The other end of connecting rod 124 is pivotally connected to a depending mount 127 carried by the platform 111. Upon operation of the variable speed motor 120, the platform 111 will be moved back and forth along the guide path defined by the channel members 115A and 115B. In addition, each end portion of the guide path defined by channel members 115A and 115B is slotted as at 128 and a ramp block 52 is mounted within the corresponding channel member end through the utilization of the fastener 54. Each ramp block 52 may be independently adjusted longitudinally of the corresponding channel member end for engagement by the corresponding guide wheel 114 of the platform 111. In addition, channel members 115A and 115B including openings 115C in the upper flanges thereof so that guide wheels 114 may readily move in the vertical direction upon engagement with ramp block 52. In this way, a preselected end of the platform 111 may be raised and lowered as it travels to the end of the guide path defined by channel members 115A and 115B and ramp blocks 52. The guide path may thus be variably modified since ramp block 52 may be shifted longitudinally from retracted positions closely adjacent the ends of the corresponding channel members to positions wherein they may be engaged by wheels 114 of platform 111.

Figure 5B:
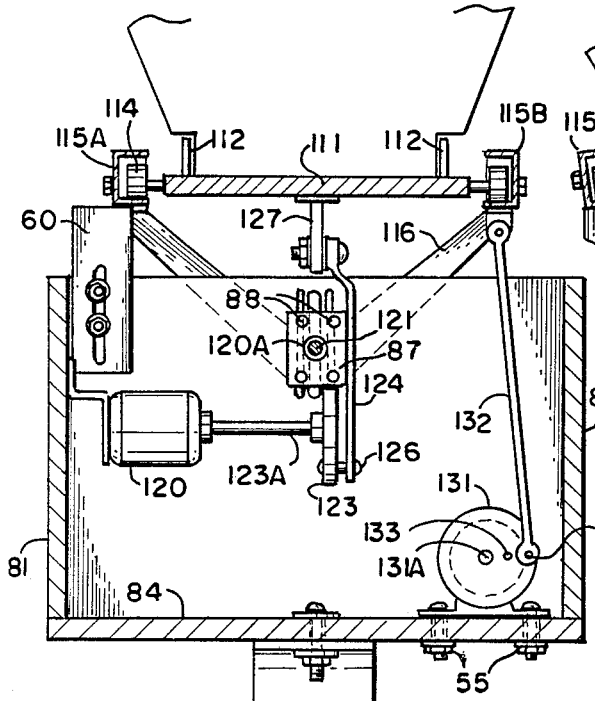
FIG. 5B is a partially broken away cross-sectional view of a cradle rocking apparatus in which the cradle rocker is in an advanced position relative to the position shown in FIG. 5.
Figure 5B:
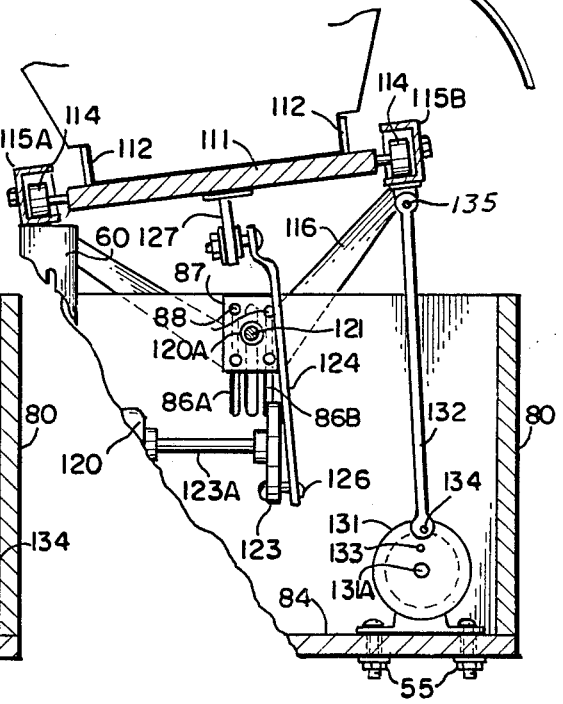
Figure 5A:
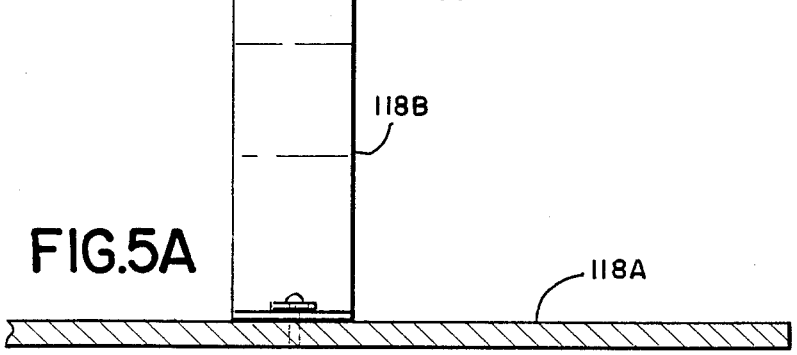
FIG. 5A is a cross-sectional of the apparatus shown in FIG. 3 showing the cradle rocking apparatus in a first position.

As best revealed in FIGS. 3, 5 and 6, a second variable speed electric motor 130 is mounted from the bottom wall 84 through the utilization fasteners 55 received through longitudinal slot 56 and the bottom wall 84. The motor 130 includes a rotary output shaft 131A upon which a crank disk 131 is mounted. The disk 131 includes radially spaced openings 133 in which a crank pin 134 may be selectively secured. The crank pin 134 pivotally attaches one end of the connecting rod 132 to crank disk 131. The other end of connecting rod 132 is pivotally attached to a rod 135 underlying channel member 115B in any manner well known in the art such that the connecting rod end may be readily shifted longitudinally of that channel member. The slot 56 enables the motor 130 to also be shifted longitudinally.

In a manner similar to that described in the previous embodiment, operation of the motor 130 causes the guide frame 113 to be oscillated about the central axis of shaft 121. However, the end wall 83 includes a vertically adjustable abutment block 60 supported therefrom. As shown in FIG. 5, abutment block 60 is mounted adjacent to side wall 81. The abutment block 60 may thus be moved into an interfering position with respect to the overlying channel member 115A for at least a portion of the oscillatory movement of guide frame 113 about the axis of shaft 121. It will be appreciated by those skilled in the art that such interference coupled with the continuing upward movement of connecting rod 132 will cause the guide frame 113 to oscillate about the point of contact between abutment block 60 and the channel member with which it interferes, i.e. channel member 115A. Such pivot point conversion according to the present invention is possible due to the structure of the present invention, particularly the vertically slidable journal blocks described above. It will be appreciated by those skilled in the art that the provision of the abutment block and the vertically slidable journal block according to the present invention provides a cradle rocker which has a high degree of flexibility in terms of the motions that may be imparted to the cradle. In particular, with special reference to FIGS. 5 and 6, that rotation of disk 131 will cause pivoting motion about the central axis of rod 121 when abutment block 60 is in a non interfering position with respect to channel member 115A. As the rotation of disk 131 continues, the guide frame 113 continues to pivot about the central axis of rod 121 until channel member 115A is interfered with by abutment block 60, at which point the further downward movement of channel member 115A is prevented. As is best revealed in FIG. 6, continued rotation of disk 131 results in the upward movement of connecting rod 132 which in turn causes journal blocks 87 to slide upward in slots 86A and 86B. In this way, motor 130 then causes guide frame 113 to pivot about the point of contact between channel member 115A and abutment block 60. It will be appreciated by those skilled in the art that adjustment of abutment block 60 can be used to vary the extent and duration of the pivoting motion about the respective pivot points. In particular, adjustment of abutment block 60 to its lowest position will allow guide frame 113 to oscillate only about the central axis of rod 121, while adjustment of abutment block 60 to is maximum vertical height will cause pivoting motion of the guide frame 113 only about the point of contact between channel member 115A and abutment block 60. Adjustment of abutment block 60 between these two extremes will cause a combination of the two motions in varying degrees and extent.

It should be noted that guide frame 113 may be at least somewhat flexible in a torsional manner. Therefore, interference between one corner of the guide frame 113 and block 60 may cause limited twisting of the guide frame. However, as best revealed in FIG. 4, the longitudinal central portion of side wall 81 also includes a second vertically adjustable abutment block 61 which may be vertically adjusted for abutment against the longitudinal mid portion of the adjacent channel member 115A. If the abutment block 61 is thus positioned to interfere with channel member 115A and the electric motor 130 and connecting rod 132 are adjusted longitudinally of the support frame to a longitudinal mid portion thereof, torsional flexure of guide frame 113 can be eliminated.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the claims that follow.

What is claimed is:

1. A cradle rocker comprising:

(a) a base;

(b) a support frame supported by said base and extending upwardly therefrom;

(c) a guide frame having a guide path, said guide frame being pivotally and slidably mounted to said support frame for pivotal movement about a central longitudinal axis of the guide frame and for vertical sliding movement;

(d) a platform movably mounted to said guide frame for movement along said guide path, said platform including means for mounting the cradle thereto;

(e) a first electric motor mounted to said support frame and coupled to said platform for moving said platform back and forth along said guide path;

(f) a second electric motor adjustably mounted to said support frame for longitudinal adjustment therealong, including a connecting arm and a rotatable disk, one end of said connecting arm being pivotally mounted to said guide frame at a point on one side of said central longitudinal axis of the guide frame, the other end of said connecting arm being pivotally and eccentrically coupled to said disk, the rotation of said disk causing oscillatory pivotal movement of said guide frame about said central longitudinal axis; and (g) an abutment block adjustably mounted to said support frame for adjustably interfering with said pivotal movement of said guide frame at a point on the other side of said central longitudinal axis.

2. The cradle rocker of claim 1 wherein said support frame is spring mounted to said base.

3. The cradle rocker of claim 1 wherein said guide path comprises a linear longitudinal guide path.

4. The cradle rocker of claim 1 wherein said guide path comprises a sinusoidal guide path.

5. The cradle rocker of claim 1 wherein said guide frame comprises a pair of parallel spaced guide rails and said guide path is defined by said guide rails.

6. The cradle rocker of claim 5 further comprising a ramp block adjustably mounted to said guide rails for adjustment along the longitudinal direction of said guide rails, said ramp block further defining said guide path.

7. The cradle rocker of claim 6 wherein said platform further includes rollers rotatably attached thereto for movement along said guide path.

8. An apparatus for supporting a cradle comprising:

(a) a base;

(b) a support frame supported by said base;

(c) a guide frame defining a longitudinal guide path, said guide frame being mounted to said support frame for pivotal movement about a central longitudinal axis of said guide frame and for vertical sliding movement;

(d) a platform movably mounted to said guide frame for movement along said guide path, said platform including means for mounting the cradle thereto;

(e) means for moving said platform back and forth along said guide path;

(f) means for imparting pivotal movement about said central longitudinal axis to said guide frame; and (g) means for converting at least a portion of said pivotal movement into said vertical sliding movement of said guide frame.

9. The apparatus of claim 8 wherein said means for imparting pivotal movement comprises a connecting arm pivotally attached to said guide frame on one side of said central longitudinal axis.

10. The apparatus of claim 9 wherein said means for converting comprises an abutment block adjustably mounted to said support frame for adjustably interfering with said pivotal movement of said guide frame at a point on the other side of said central longitudinal axis.

11. The apparatus of claim 10 wherein the point of connection between said connecting arm and said guide frame is approximately longitudinally centrally located with respect to said guide frame and said abutment block is longitudinally adjustable to a position opposite said connecting arm.

12. An apparatus for supporting a cradle comprising:

(a) a support frame;

(b) a guide frame defining a longitudinal guide path, said guide frame being pivotally mounted to said support frame for pivotal movement about a longitudinal axis of the guide frame;

(c) a platform supported by said guide frame for movement along said guide path, said platform including means for mounting the cradle thereto;

(d) means for moving said platform back and forth along said guide path; and (e) means for imparting pivotal movement about said longitudinal axis to said guide frame.

13. The apparatus of claim 12 further comprising a stationary base supporting said support frame.

14. The apparatus of claim 12 wherein said guide path is a linear guide path.

15. The apparatus of claim 12 wherein said guide path comprises a sinusoidal guide path.

16. The apparatus of claim 12 wherein said longitudinal axis is a central longitudinal axis.

17. The apparatus of claim 16 wherein said central longitudinal axis of said guide frame is a central longitudinal axis of said guide path.

18. The apparatus of claim 17 further including means for converting at least a portion of said pivotal movement into vertical sliding movement of said guide frame.

19. The apparatus of claim 18 wherein said means for converting comprises said guide frame being supported by a journal block vertically slidably mounted to said support frame.

20. The apparatus of claim 19 wherein said means for converting further comprises an abutment block mounted to said support frame for interfering with said pivotal movement of said guide frame.

* * * * *